US008918959B2

(12) United States Patent
Keller

(10) Patent No.: US 8,918,959 B2
(45) Date of Patent: Dec. 30, 2014

(54) HINGE CONNECTION FOR A TRANSPORT CONTAINER MADE OF PLASTIC

(75) Inventor: André Keller, Unterlunkhofen (CH)

(73) Assignee: Georg Utz Holding AG, Bremgarten (CH)

( * ) Notice: Subject to any disclaimer, the term of this patent is extended or adjusted under 35 U.S.C. 154(b) by 176 days.

(21) Appl. No.: 13/320,319

(22) PCT Filed: May 4, 2010

(86) PCT No.: PCT/IB2010/051957

§ 371 (c)(1),
(2), (4) Date: Feb. 1, 2012

(87) PCT Pub. No.: WO2010/131159

PCT Pub. Date: Nov. 18, 2010

(65) Prior Publication Data

US 2012/0124777 A1 May 24, 2012

(30) Foreign Application Priority Data

May 13, 2009 (CH) ..... 752/09

(51) Int. Cl.

| | |
|---|---|
| ***E05D 15/50*** | (2006.01) |
| ***E05D 15/06*** | (2006.01) |
| ***E05D 5/14*** | (2006.01) |
| *E05D 7/10* | (2006.01) |
| *E05D 5/12* | (2006.01) |

(52) U.S. Cl.

CPC ..... *E05D 5/14* (2013.01); *E05Y 2600/524* (2013.01); *E05Y 2600/53* (2013.01); *E05Y 2800/676* (2013.01); *E05Y 2800/682* (2013.01); *E05D 2005/145* (2013.01); *E05D 7/1077* (2013.01); *E05Y 2600/60* (2013.01); *E05D 5/12* (2013.01)

USPC ..... 16/261; 16/250; 16/270; 16/380

(58) Field of Classification Search

USPC ..... 16/381, 171, 172, 169, 175, 250, 254, 16/260, 261, 262, 263, 265, 266, 268, 271, 16/386, 270, 380, 385

See application file for complete search history.

(56) References Cited

U.S. PATENT DOCUMENTS

| | | | | | |
|---|---|---|---|---|---|
| 442,376 | A * | 12/1890 | Hoover | 126/194 |
| 1,942,510 | A * | 1/1934 | Freiberg | 16/259 |
| 2,141,449 | A * | 12/1938 | Rathbun | 220/829 |
| 2,586,757 | A * | 2/1952 | Wummel et al. | 16/250 |
| 3,746,206 | A * | 7/1973 | Utz | 220/214 |
| 3,971,099 | A * | 7/1976 | Wallace | 16/50 |
| 6,817,062 | B2 * | 11/2004 | Cho | 16/328 |

(Continued)

FOREIGN PATENT DOCUMENTS

FR 2 623 553 A1 5/1989

*Primary Examiner* — Emily Morgan
(74) *Attorney, Agent, or Firm* — Henry M. Feiereisen LLC

(57) ABSTRACT

The invention relates to a novel hinge connection (1) for a transport container made of plastic, which hinge connection comprises a hinge part (2) designed as a sleeve (4) having a longitudinal opening (5) and a hinge clip (3) that encompasses the sleeve. The sleeve has a wide outer circumferential groove (6) for receiving the hinge clip, which has a recess (7) at least at one of the ends thereof. The hinge clip (3) further comprises at one end a detent (9) that projects inward for engaging with the recess.

5 Claims, 2 Drawing Sheets

(56) References Cited

U.S. PATENT DOCUMENTS 7,178,198 B2 * 2/2007 Elmer ..... 16/252
2003/0221287 A1 * 12/2003 Cho ..... 16/328
2011/0047748 A1 * 3/2011 Chien ..... 16/250
2012/0096677 A1 * 4/2012 Ho ..... 16/250

* cited by examiner

HINGE CONNECTION FOR A TRANSPORT CONTAINER MADE OF PLASTIC

CROSS-REFERENCES TO RELATED APPLICATIONS

This application is the U.S. National Stage of International Application No. PCT/IB2010/051957, filed May 4, 2010, which designated the United States and has been published as International Publication No. WO 2010/131159 and which claims the priority of Swiss Patent Application, Serial No. 00752/09, filed May 13, 2009, pursuant to 35 U.S.C. 119(a)-(d).

BACKGROUND OF THE INVENTION

The invention relates to a hinge connection between a cover and a transport container made of plastic.

For increasing the mechanical strength of a hinge connection between a cover and a transport container, hinge clips made of metal are typically used which are clamped onto the hinge in a wide groove. The hinge clip is formed as a circular-cylindrical sleeve extending over a circle of an arc of approximately 270° and has a bore to additionally attach the clamp with a screw or a rivet on the hinged part of the cover. Such hinge with a hinge clip is described, for example, in Euro-Catalogue 1996 from the company Georg Utz AG, page 35. Several problems are encountered when using metallic hinge clips on a hinge part of the cover to thus form a hinge connection with the transport container made of plastic. The metallic hinge clips must be held in place during assembly and pushed onto the wide groove of the hinge part with a hammer. The hinge clips are made of spring steel and can only be removed again with a tool. When these transport containers are recycled, the hinge clips must be removed first, before the containers can be ground up in a mill.

It is the object of the present invention to provide a simple and recyclable hinge connection for a cover on a transport container which has a mechanical stability which is comparable to that of a hinge connection secured by a metallic hinge clip.

SUMMARY OF THE INVENTION

The object is attained by a hinge connection for a transport container made of plastic with a hinge part constructed as a sleeve and having a longitudinal opening and a wide circumferential outer groove having ends, with a recess disposed on at least on one of the ends of the circumferential outer groove, and a hinge clip encompassing the sleeve and having two ends, wherein the hinge clip is received in the circumferential outer groove which has an inwardly projecting detent disposed on an end of the circumferential outer groove and configured to lock in the recess. The hinge clip further includes a bridge-shaped reinforcement arranged at a center located between the two ends of the hinge clip and constructed to fit in the longitudinal opening of the hinge part.

The hinge connection according to the invention has the significant advantage of being particularly easy to assemble, very stable and facilitating a simple exchange of existing hinge connections of the aforedescribed type.

BRIEF DESCRIPTION OF THE DRAWING

The invention will now be described in more detail with reference to an exemplary embodiment illustrated in the schematic drawings. It is shown in.

DETAILED DESCRIPTION OF PREFERRED EMBODIMENTS

Figure 1:
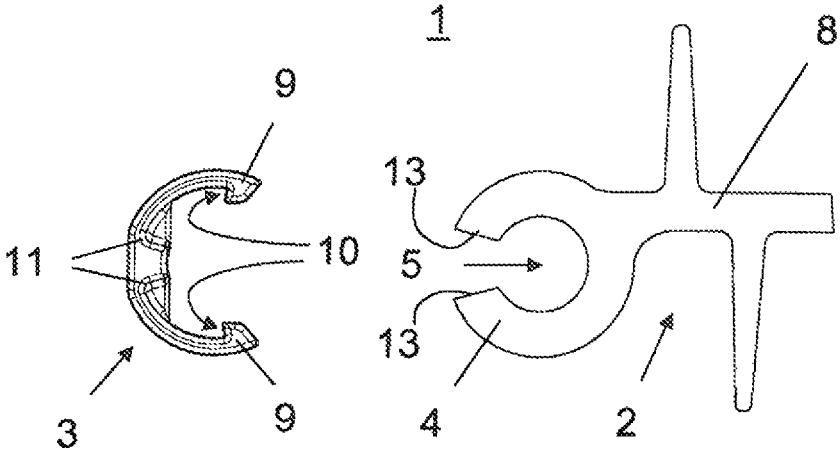
FIG. 1 a side view on a hinge part and a hinge clip,
FIG. 2 a perspective view of the hinge part,
FIG. 3 a perspective view of the hinge clip, and
FIG. 4 a perspective view of the installed hinge connection.
Figure 2:
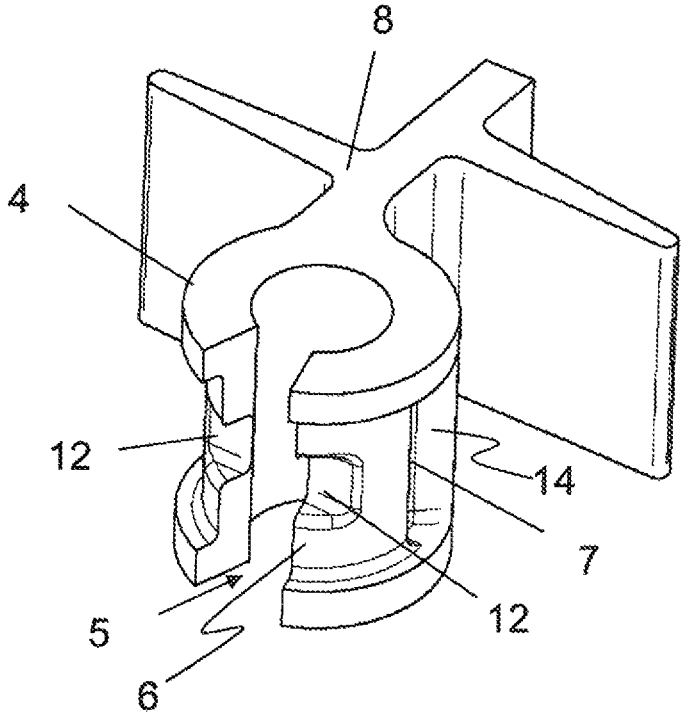
Figure 3:
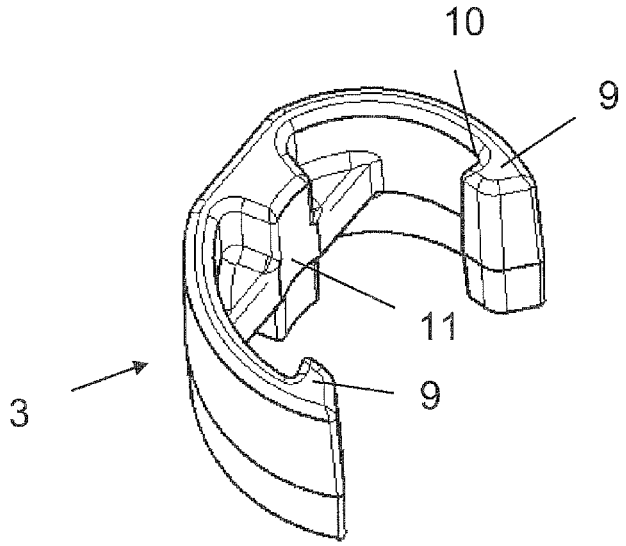
Figure 4:
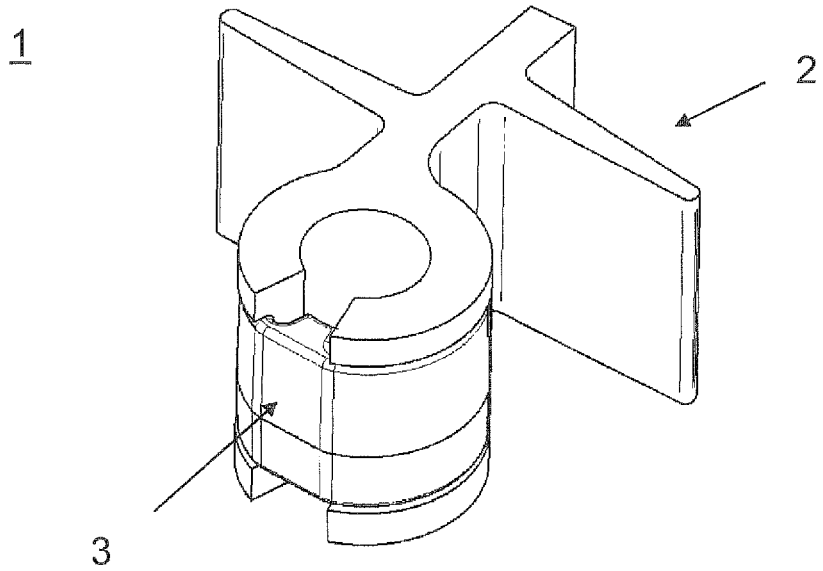

FIGS. 1 to 4 illustrate a hinge connection 1 for a transport container made of plastic, wherein the hinge connection 1 has a hinge part 2 and a hinge clip 3. The hinge part 2 is constructed as a sleeve 4 with a longitudinal wedge-shaped opening 5 and free end 13, wherein the sleeve 4 has wide outer grooves 6 with dead end 14 and a trough-shaped recess 7 arranged at both dead ends 14 on both sides of the longitudinal opening 5. The sleeve 4 is connected with an angular connecting piece 8 which is part of the cover of the transport container (not illustrated in detail). The hinge clip 3 has the same width as the wide outer groove 6 of the hinge part 2 and has a rod-shaped detent 9 with a locking edge 10. As seen in the Figures, the hinge clip 3 is formed as a circular cylinder with a circular arc of approximately to 220°. This circular arc should be greater than 180° and smaller than 270°, and should be particularly in a range from 200° to 240° so as to ensure adequate clamping of the hinge clip 3 on the hinge part 2. The hinge clip 3 also includes a bridge-shape reinforcement 11 arranged centrally to the two ends or detents 9 so as to fit into the longitudinal opening 5. For this purpose, additional trough-shaped recesses 12 are provided on the free ends 13 of the sleeve 4 in which the bridge-shaped reinforcement 11 can be clamped. The bridge-shaped reinforcement 11 thus provides high stability to the hinged clip 3 and excellent spring elasticity at the ends of the detents 9.

The hinge connection 1 is produced from the same plastic material (polyethylene or polypropylene) as the transport container, so that the entire plastic container can be easily recycled.

The hinge part 2 does not necessarily require a hinge clip 3 because it is clamped on the container on a pivot pin. The hinge clip 3 is used only to additionally secure the cover. Advantageously, the hinge clip 3 and therefore also the cover on which the hinge part 3 is formed can be easily removed without use of a tool.

A person skilled in the art will understand that two rod-shaped detents may be provided instead of a single rod-shaped detent 9. It is also not necessary to provide detents on both sides of the hinge clip 3; instead, a single detent 9 and a single recess in the hinge part 2 may be sufficient.

The invention claimed is:

1. A hinge connection for a transport container made of plastic, said hinge connection defining a longitudinal axis and a transverse direction perpendicular to the longitudinal axis, comprising:

a plastic hinge part constructed as a single sleeve, having free ends creating a wedge-shaped longitudinal opening, and a circumferential outer groove extending partially around the sleeve extending in the transverse direction away from a central point mid-way between the free ends to a dead end, and two longitudinal recesses in the circumferential outer groove, one adjacent each dead end of the circumferential outer groove, and a transverse recess disposed in the circumferential outer groove and adjacent the longitudinal opening, and extending in the transverse direction away from the central point, and a plastic hinge clip shaped as a circular arc having two ends and configured to engage in the circumferential outer groove, with an inwardly projecting detent arranged on at least one of the two ends and configured to lock in a corresponding longitudinal recess of the hinge part, wherein the hinge clip comprises a radially inwardly facing reinforcement located between the two ends of the hinge clip, said reinforcement having a longitudinal extent configured to fit in the wedge-shaped longitudinal opening of the hinge part and a transverse segment configured to fit in the transverse recesses in the circumferential groove of the hinge part.

2. The hinge connection of claim 1, wherein the hinge clip has an inwardly projecting detent disposed on each of the two ends which correspond to the longitudinal recesses.

3. The hinge connection of claim 1, wherein the longitudinal recesses are trough-shaped.

4. The hinge connection of claim 1, wherein the detent is rod-shaped with a locking edge.

5. The hinge connection of claim 1, wherein the hinge clip is formed as a circular cylinder with a circular arc having an angle between 200° and 240°.

* * * * *